United States Patent [19]

Shoji et al.

[11] Patent Number: 4,853,909

[45] Date of Patent: Aug. 1, 1989

[54] TIME CORRECTION MECHANISM FOR AN ANALOG TIMEPIECE USING PLASTIC GEARS FOR TRANSMITTING THE ROTATION OF THE MANUAL OPERATION MEMBER TO THE HANDS

[75] Inventors: Masaru Shoji, Saitama; Mitsunobu Yatabe, Tokyo, both of Japan

[73] Assignee: Casio Computer Co., Ltd., Tokyo, Japan

[21] Appl. No.: 175,155

[22] Filed: Mar. 30, 1988

[30] Foreign Application Priority Data

Apr. 9, 1987 [JP] Japan ..... 62-54038[U]
Apr. 9, 1987 [JP] Japan ..... 62-54040[U]

[51] Int. Cl.[4] ..... G04B 27/02

[52] U.S. Cl. ..... 368/190; 368/88; 368/220; 368/223; 368/319

[58] Field of Search ..... 368/88, 190, 191–199, 368/220, 185, 319–327

[56] References Cited

U.S. PATENT DOCUMENTS

| | | | |
|---|---|---|---|
| 3,977,275 | 8/1976 | Kiesewetter | 368/220 |
| 4,320,481 | 3/1982 | Hofert | 368/190 |
| 4,636,087 | 1/1987 | Suzuki | 368/185 |
| 4,711,584 | 12/1987 | Tanazawa et al. | 368/88 |

FOREIGN PATENT DOCUMENTS 2127991 4/1984 United Kingdom .

*Primary Examiner*—Bernard Roskoski
*Attorney, Agent, or Firm*—Holtz, Goodman & Woodward Frishauf

[57] ABSTRACT

In a time-setting mechanism for an analog time-piece, when an operation member is moved in its axial direction, a pinion provided on the operation member is brought into mesh with a gear which is normally rotated in an interlocked relation to hands. When the operation member is turned in this state, the torque thereof is transmitted via the pinion and gear to the hands for time-setting. The pinion and gear are made of synthetic resins, and the pinion is made of a resin material having higher flexibility than the resin material of the gear.

20 Claims, 4 Drawing Sheets

TIME CORRECTION MECHANISM FOR AN ANALOG TIMEPIECE USING PLASTIC GEARS FOR TRANSMITTING THE ROTATION OF THE MANUAL OPERATION MEMBER TO THE HANDS

BACKGROUND OF THE INVENTION

1. Field of the Invention

This invention relates to a time-setting mechanism for an analog timepiece.

2. Description of the Related Art

In order to set time by a time-setting mechanism for an analog timepiece disclosed in U.S. Pat. No. 4,636,087, at first an operation member is pulled out to move a pinion slidably mounted on the operation member so that the pinion meshes with a setting gear. When the operation member is turned in this state, the pinion is rotated therewith, and this rotation is transmitted via the setting wheel to a minute wheel. The minute gear rotates a center wheel, on which a minute hand is attached, and an hour wheel, on which an hour hand is attached, to set time.

The gears used for such conventional time-setting mechanism should have high mechanical strength because the torque of the operation member is directly applied to these gears. For this reason, these conventional gears are made of metals.

Recently, engineering plastics having high mechanical strength have been developed, and gears, made of engineering plastic materials and used in a timepiece gear train, are well known as showed in GB No. 2,127,991. Since the gears in the timepiece gear train rotate at a constant speed and with a constant torque at all time, they will not be broken even if they are made of engineering plastics as noted above. However, there is a high possibility that various gears in a time-setting mechanism are broken if these gears are made of engineering plastics like the gears in the timepiece gear train. This possibility is particularly high at the pinion and the setting wheel in the time-setting mechanism, which are brought into engagement with each other and disengaged from each other.

More specifically, when the pinion is brought into mesh with the setting wheel by pulling out an operation member at the time of the time-setting, it is highly possible that the teeth tops of the pinion and setting wheel collide with one another. If these gears are made of engineering plastic materials, the collision noted above will cause breakage or deformation of the teeth tops of the pinion and setting wheel, thus resulting in failure of transmission or failure of smooth transmission of rotation between the pinion and the setting wheel.

Further, it is liable that the teeth of the pinion are seized by the teeth of the setting wheel or conversely the teeth of the setting wheel are seized by the teeth of the pinion when the pinion is brought into mesh with the setting wheel by pulling out the operation member. When the operation member is turned in this state, its torque is concentratedly applied to the teeth of the gear that are seized by the teeth of the other gear. If the gears of the time-setting mechanism are made of engineering plastic materials, the seized teeth of the pinion or setting wheel will be broken or deformed to result in the failure of transmission or failure of smooth transmission of the rotation between the pinion and the setting wheel.

Particularly, since the setting wheel is in mesh with the minute wheel in the timepiece gear train at all time, if the teeth of the setting wheel are broken or deformed, the hands will not move normally.

SUMMARY OF THE INVENTION

An object of the invention is to provide a time-setting mechanism for an analog timepiece, which prevents plastic deformation or breakage of the gears used in the mechanism even if these gears are made of synthetic resins, so that satisfactory operation of the timepiece gear train is ensured.

To attain the above object of the invention, there is provided a time-setting mechanism for an analog timepiece, comprising:

an operation member movable in the axial direction thereof at least between a first position and a second position;

a pinion movable from a first position to a second position in an interlocked relation to the movement of the operation member from the first position to the second position and rotatable, together with the operation member, when the operation member is turned; and an external torque-transmission gear normally rotated in an interlocked relation to the movement of hands, and brought into mesh with the pinion to transmit a torque, produced by rotation of the operation member and transmitted from the operation member to the pinion, to the hands when the pinion is moved to the second position with movement of the operation member to the second position; characterized in that the pinion and external torque-transmission gear are made of synthetic resin, and the pinion is made of a resin material having a higher flexibility than the resin material of the external torque-transmission gear.

According to the invention constructed as described above, the torque, which is greater than the normal torque and is applied to the teeth of the pinion and/or the gear in the time-setting mechanism in the time-setting operation, is absorbed by the gear meshing with the pinion, so that it is possible to cause smooth and satisfactory mesh between the pinion and gear and prevent plastic deformation and breakage of the gear. Thus, it is possible to set time smoothly, and obtain smooth operation of the gear train mechanism.

DESCRIPTION OF THE PREFERRED EMBODIMENTS

Figure 1:
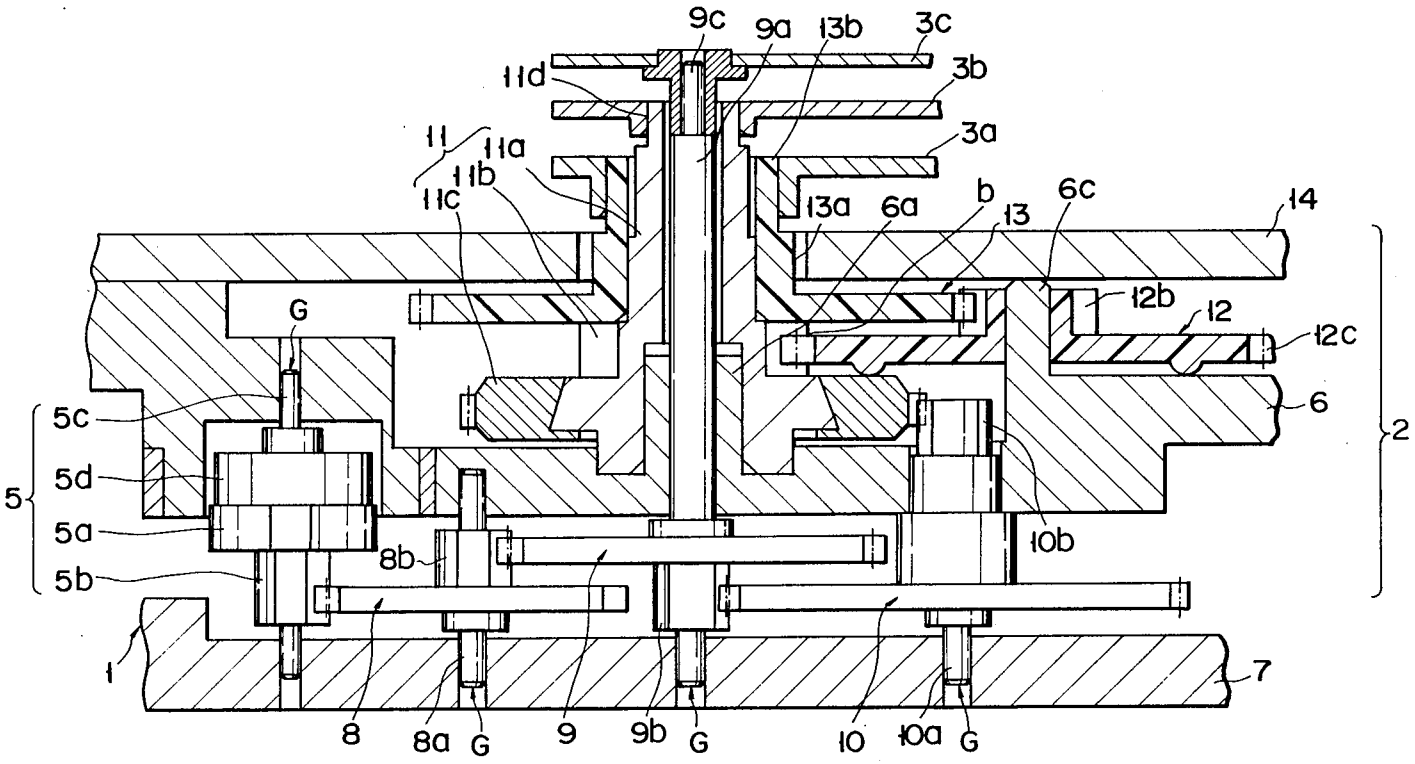
FIG. 1 is a schematic sectional view showing an analog movement mechanism as an essential part of an analog watch with a time-setting mechanism according to the invention.

FIG. 1 is a longitudinal sectional view schematically showing an analog movement mechanism as essential part of a battery-powered type analog wrist-watch. In this analog movement mechanism, the rotation of rotor 5 of stepping motor 1 is transmitted to gear train mechanism 2. Gear train mechanism 2 moves hour, minute, and second hands 3*a*, 3*b*, and 3*c* to indicate time on dial 14.

Figure 2:
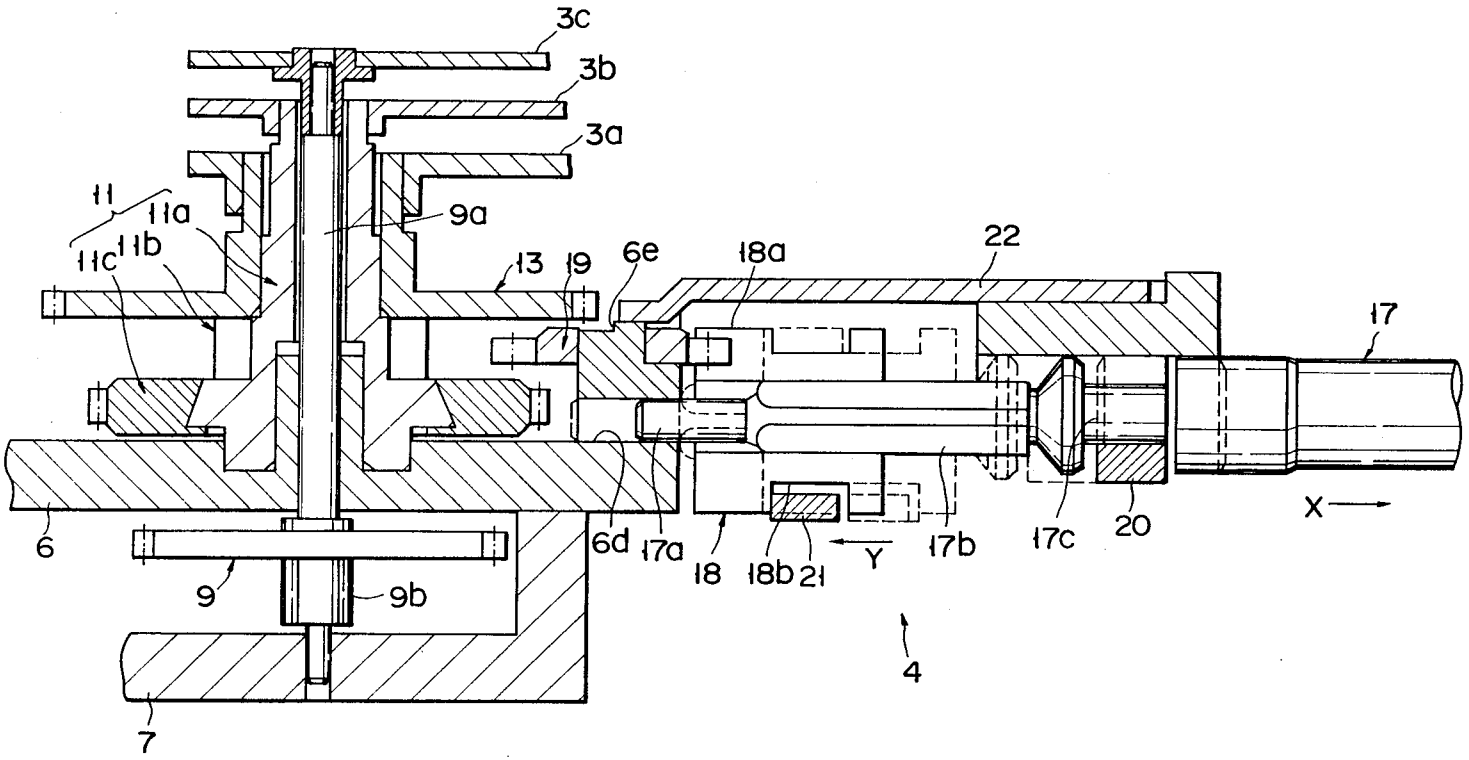
FIG. 2 is a schematic longitudinal sectional view showing a time-setting mechanism coupled to the analog movement mechanism of the analog watch shown in FIG. 1.

Time-setting in the analog movement mechanism shown in FIG. 1 is carried out by time setting mechanism 4 the longitudinal sectional view of which is shown in FIG. 2.

Stepping motor 1 is a drive source for moving hour, minute, and second hands 3*a*, 3*b*, and 3*c*, and it consists of rotor 5, a stator (not shown), a coil, etc. Every time an inversion pulse of a constant repetition period is supplied to the coil, rotor 5 executes one step rotation for 180° in one direction. In this embodiment, rotor 5 consists of rotor body 5*a*, rotor pinion 5*b*, and rotor shaft 5*c*, as shown in FIG. 1, and these components are integrally formed of a polyacetal resin containing potassium titanate wisker by a one-piece molding. Magnet ring 5*d* is fitted on rotor body 5*a*, and rotor shaft 5*c* are rotatably supported at its opposite ends by main plate 6 and bearing plate 7. When rotor 5 is integrally formed of the resin noted above, resin injection gate G is provided at a position corresponding to the upper end surface of rotor shaft 5*c*.

Gear train mechanism 2, which moves hour, minute, and second hands 3*a*, 3*b*, and 3*c* by rotation of stepping motor 1, consists of fifth wheel 8, second wheel 9, third wheel 10, center wheel 11, minute wheel 12, and hour wheel 13. The opposite ends of the shafts of fifth wheel 8, second wheel 9, and third wheel 10 are rotatably supported by main plate 6 and bearing plate 7. Center wheel 11, minute wheel 12, and hour wheel 13 are rotatably supported on main plate 6. In this embodiment, main plate 6 and bearing plate 7 are made of a polyetherimide resin containing 40% of glass filler. Dial 14 is provided above main plate 6.

Fifth wheel 8 is meshing with rotor pinion 5*b* of stepping motor 1. Fifth wheel 8 is integrally formed of polyacetal resin containing potassium titanate wisker by one-piece molding to have shaft portion 8*a* and fifth wheel pinion 8*b*. At the time of the molding, resin injection gate G is disposed at a position corresponding to the lower end surface of shaft portion 8*a*.

Second wheel 9 meshes with fifth wheel pinion 8*b* of fifth wheel 8, and is rotated by torque transmitted from stepping motor 1 via fifth wheel 8 to move second hand 3*c*. Its shaft portion 9*a* functions as a second hand shaft and upwardly penetrates bearing portion 6*a* of main plate 6 and dial 14. The upwardly projecting portion of shaft portion 9*a* functions as a second hand support portion 9*c*. Second wheel 9 is formed of polyetherimide resin containing 15% of potassium titanate wisker by one-piece molding to have shaft portion 9*a* and second wheel pinion 9*b*. When molding this gear, resin injection gate G is disposed at a position corresponding to the lower end surface of shaft portion 9*a*. Bearing portion 6*a* of main plate 6, through which shaft portion 9*a* is inserted, has a sufficient height to prevent rotating axis of shaft portion 9*a* from offcentering.

Third wheel 10 meshes with second wheel pinion 9*b* of second wheel 9 and is rotated by torque transmitted therefrom. Third wheel 10 is formed of polyacetal resin containing potassium titanate wisker by one-piece molding to have shaft portion 10*a* and third wheel pinion 10*b*. In this embodiment, third wheel pinion 10*b* upwardly penetrates main plate 6. When molding this third wheel 10, resin injection gate G is disposed at a position corresponding to the lower end surface of shaft portion 10*a*.

Center wheel 11 meshes with third wheel pinion 10b of third wheel 10 and is rotated by torque transmitted therefrom. Sleeve-like shaft portion 11*a* of center wheel 11 is rotatably fitted on the outer periphery of bearing portion 6*a* of main plate 6. An upper end of shaft portion 11*a* projects upwardly from dial 14, and minute hand 3*b* is attached on the upwardly projecting portion. Shaft portion 11*a* of center wheel 11 has center wheel pinion 11*b* at its position below dial 14. Center wheel gear 11*c* is molded on the outer periphery of shaft portion 11*a* by one-piece molding so as to be rotatable thereon with slip. Shaft portion 11*a* is formed of polyetherimide resin containing 15% of potassium titanate wisker. This material for shaft portion 11*a* has a high wear resistance and a high strength, and further has a higher melting point than that of the material of center wheel gear 11*c*. Center wheel gear 11*c* is formed of a "12 nylon" resin containing potassium titanate wisker. The material for gear 11*c* has low degree of shrinkage and a lower melting temperature than the material of shaft portion 11*a*. Center wheel 11 thus has a predetermined adequate slip torque (of 3 to 6 g.cm in this embodiment), and shaft portion 11*a* may slip on center wheel gear 11*c* at its outer periphery right under center wheel pinion 11*b* when it receives a torque (i.e., load) higher than the predetermined slip torque noted above.

Minute wheel 12 meshes with the teeth b of center wheel pinion 11*b*. Teeth b have an involute tooth shape.

Minute wheel 12 is rotated by torque transmitted from center wheel 11. Minute wheel 12 is formed of polyacetal resin containing potassium titanate wisker by one-piece molding to have minute wheel pinion 12*b*. It is rotatably fitted on the outer periphery of shaft portion 6*c* projecting upward from the upper surface of main plate 6. In this embodiment, gear 12*c* of minute wheel 12 has the same involute tooth shape as teeth b of center wheel pinion 11*b* of center wheel 11 so as to mesh with teeth b of center wheel pinion 11*b*.

Hour wheel 13 meshes with minute wheel pinion 12*b* of minute wheel 12 and is rotated by torque transmitted therefrom. Hour wheel 13 is formed of polyacetal resin containing potassium titanate wisker, and its sleeve-like shaft portion 13*a* is rotatably fitted on the outer periphery of shaft portion 11*a* of center wheel 11. Upper end of shaft portion 13*a* upwardly projects from dial 14, and the projected upper end functions as hand support portion 13*b* on which hour hand 3*a* is press fitted.

The teeth of the gears in gear train mechanism 2 except for teeth b of center wheel 11 and teeth 12*c* of minute wheel 12 meshing with teeth b have cycloid tooth shapes.

Time-setting mechanism 4 shown in FIG. 2 comprises operation member 17, pinion 18, setting wheel 19, setting lever 20, and yoke 21, and these components are provided on main plate 6.

More specifically, operation member 17 is provided on main plate 6 such that it is slidable in the direction of its own axis and rotatable about the axis. Its sliding and rotation are caused by a crown (not shown) outwardly projecting from a wrist-watch case. In this embodiment, operation member 17 is made of a metal. It has guide portion 17*a* formed at the inner end in its axial direction, spline portion 17*b* formed adjacent to the outer end of guide portion 17*b*, and steppedly recessed portion 17*c* adjacent to the outer end of spline portion 17*b*. Guide portion 17a is inserted in guide hole 6*d* of main plate 6 such that it is slidable in the direction of the axis of guide hole 6*d* and also rotatable thereabout. Spline portion 17*b* has a plurality of splines formed in its outer periphery. On this splined outer periphery, pinion 18 is slidably fitted. Setting lever 20 is fitted on the outer periphery of steppedly recessed portion 17*c*, and lever 20 restricts the pull-out position of operation member 17.

Pinion 18 is formed of a polyetherimide resin by one-piece molding to have a cylindrical shape at the opposite ends of which outer flanges are provided. Intermediate region on the outer periphery of pinion 18 provides recessed portion 18*b*, and teeth 18*a* is formed at the left or inner end face of the left or inner flange. In this embodiment, teeth 18*a* have an involute tooth shape. Yoke 21 is disposed on recessed portion 18*b*. Yoke 21 slides pinion 18 along spline portion 17*b* of operation member 17 in response to a pulling-out operation of operation member 17, so that teeth 18*a* of pinion 18 are brought into mesh with setting wheel 19.

Figure 3:
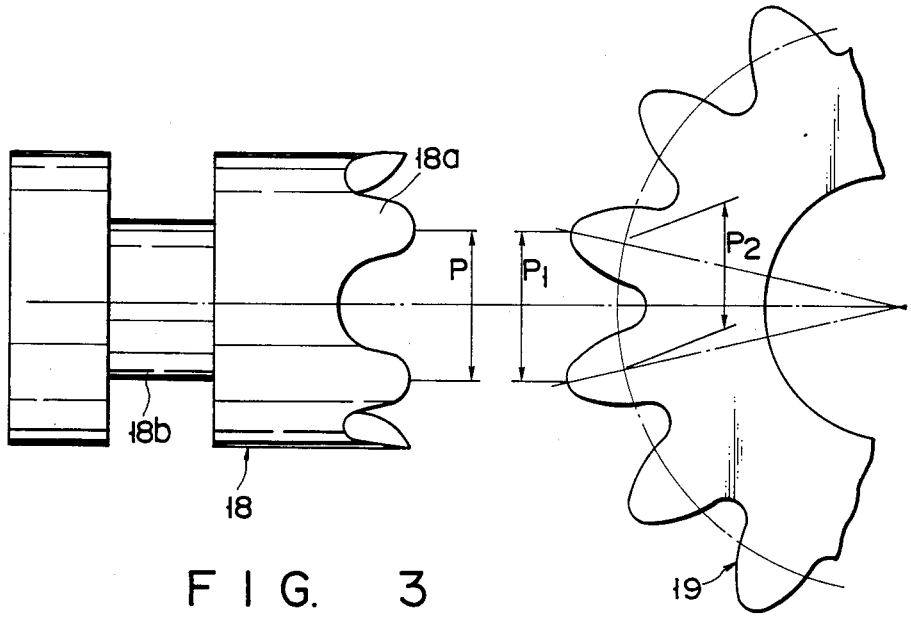
FIGS. 3 and 4 are plan views schematically showing the relation between a pinion and a setting wheel in a time-setting mechanism according to the invention, FIG. 3 showing the relation in the normal state of the analog watch, FIG. 4 showing the relation when an operation member is pulled out for time-setting.
Figure 4:
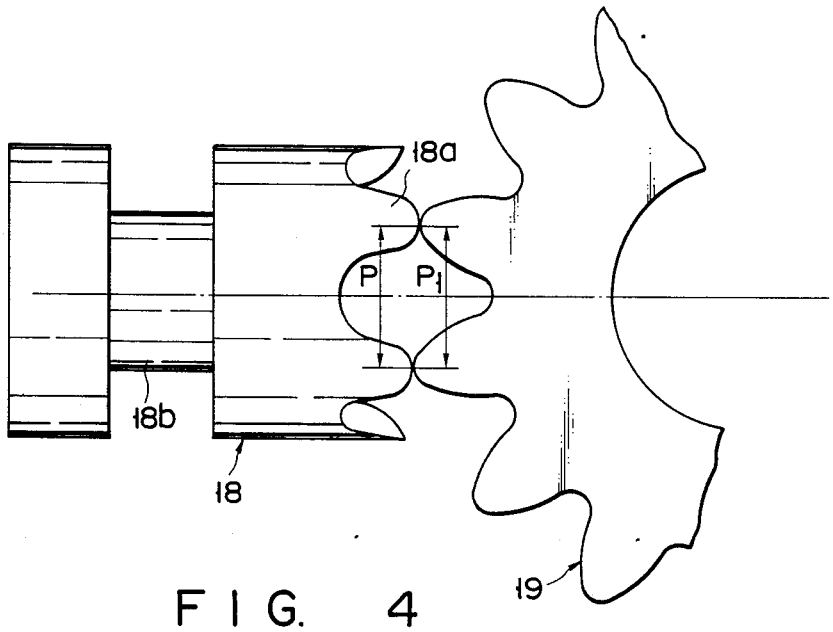
Figure 5:
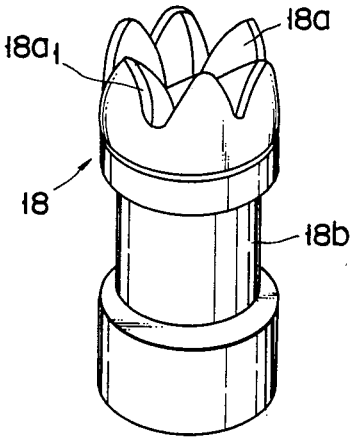
FIG. 5 is a schematic perspective view showing modification of the pinion of the time-setting mechanism according to the invention.

Setting wheel 19 transmits torque, that is transmitted from operation member 17 via pinion 18, to minute wheel 12 in gear train mechanism 2 noted above. Setting wheel 19 is formed of polyetherimide resin containing 30% of potassium titanate wisker, and is rotatably fitted on the outer periphery of shaft portion 6*e* projecting upwardly from main plate 6. Retaining plate 22 made of a metal, which is attached on top of main plate 6 below dial 14, is pressed on the upper end surface of shaft portion 6*e* to prevent setting wheel 19 from dropping out of shaft portion 6*e*. In this embodiment, each tooth of setting wheel 19 has an involute tooth shape to mesh with the teeth of pinion 18 and also teeth 12*c* of minute wheel 12. As shown in FIG. 3, the pitch P1 on the addendum circle of setting wheel 19 is substantially equal to the pitch p on the addendum circle of teeth 18*a* of pinion 18. The pitch P2 on the pitch circle of setting wheel 19 is smaller than the pitch p of pinion 18 noted above. More specifically, the pitch P1 on the addendum circle of setting wheel 19 is set to 0.9 to 1.1 times the pitch p on the addendum circle of teeth 18*a* of pinion 18 (i.e., P1=0.9 to 1.1 p). Thus, when the tooth tops of teeth 18*a* of pinion 18 collide with the tooth tops of setting wheel 19 at the time of setting time, as shown in FIG. 4, pinion 18 and setting wheel 19 can be rotated slightly in opposite directions owing to a backlash between the teeth 18*a* of pinion 18 and teeth of setting wheel 19 and a slight gap provided in a circumferential direction between spline portion 17*b* of operation member 17 and the inner periphery of pinion 18 to allow the sliding of pinion 18 described above, thus the collision of tooth tops as noted above is released. Consequently, the tooth top of teeth 18*a* of pinion 18 is led to the root of teeth of setting wheel 19 as it slides along the tooth surface of the teeth of setting wheel 19. In this way, normal meshing between teeth 18*a* of pinion 18 and teeth of setting wheel 19.

Table 1 shows the mechanical strength of pinion 18 and setting wheel 19 of time-setting mechanism 4 and minute wheel 12 of gear train mechanism 2.

TABLE 1

| | Pinion 18 | Setting Wheel 19 | Minute Wheel 12 |
|---|---|---|---|
| Rockwell hardness (ASTM-D785) | M 100 or above | M 110 or above | R 90 or above |

TABLE 1-continued

| | Pinion 18 | Setting Wheel 19 | Minute Wheel 12 |
|---|---|---|---|
| Elongation (ASTM-D638) | 40% or above | 6% or below | — — |
| Bending strength (ASTM-D790) | 1400 Kg/cm2 or above | 1400 Kg/cm2 or above | 700 Kg/cm$^2$ or above |

Now, the movement of the analog movement mechanism constructed as shown in FIG. 1 will now be described.

When rotor 5 of stepping motor 1 is rotated in a predetermined direction, the rotation is transmitted via fifth wheel 8 to second wheel 9, thus second hand 3*c* mounted on the upper end of shaft portion 9*a* of second wheel 9 is moved. The rotation of second wheel 9 is transmitted via third wheel 10 to center wheel gear 11*c* of center wheel 11. Since the strength of torque, applied by center wheel gear 11*c* to the outer periphery of shaft portion 11*a* due to the rotational force transmitted from stepping motor 1 to center wheel gear 11*c*, is smaller than the slip torque noted above, center wheel gear 11*c* transmits the rotational force to shaft portion 11*a* without a slip. Thus, minute hand 3*b* mounted on the upper end of shaft portion 11*a* of center wheel 11 is moved. The rotation of center wheel 11 is transmitted via minute wheel 12 meshing with center wheel pinion 11*b* to hour wheel 13, so that hour hand 3*a* is moved by hour wheel 13. In this way, time is indicated by hour, minute, and second hands 3*a*, 3*b*, and 3*c* moved above dial 14.

For setting time, operation member 17 of time-setting mechanism 4 shown in FIG. 2 is pulled out in the direction of arrow X and then turned in an intended direction. More specifically, when operation member 17 is pulled out in the direction of arrow X, setting lever 20 disposed on the steppedly recessed portion 17*c* of operation member 17 is moved with operation member to strike a stopper (not shown) provided on main plate 6, whereby operation member 17 is set at a predetermined position for setting time. The movement of setting lever 20 causes a movement of yoke 21 in the direction of arrow Y. Such movement of yoke 21 causes movement of pinion 18 in the same direction along spline portion 17*b* of operation member 17 to bring teeth 18*a* of pinion 18 into mesh with teeth of setting wheel 19. In FIG. 2, the positions of operation member 17, pinion 18, and yoke 21 before operation member 17 is pulled out in the direction of arrow X are shown by dashed lines, while the positions of these components after the pulling out of operation member 17 in the direction of arrow X are shown by solid lines. In this operation, teeth 18*a* of pinion 18 are smoothly brought into mesh with teeth of setting wheel 19 without causing damage to gear teeth as described before. In this state, when operation member 17 is rotated in either direction the rotation thereof is transmitted via pinion 18 to setting wheel 19, and the rotation of setting wheel 19 is in turn transmitted via minute wheel 12 to center wheel pinion 11*b* of center wheel 11 and hour wheel 13. Thus, center wheel pinion 11*b* and shaft portion 11*a* of center wheel 11 and hour wheel 13 are rotated to move hour and minute hands 3*a* and 3*b*, respectively. At this time, the strength of torque, applied on the inner periphery of center wheel gear 11*c* by the outer periphery of shaft portion 11*a* due to the torque transmitted to center wheel pinion 11*b* of center wheel 11 from operation member 17, exceeds the slip torque (3 to 6 g cm) on center wheel gear 11*c* noted above. Thus, shaft portion 11*a* slips, together with center wheel pinion 11*b*, on center wheel gear 11*c*. In other words, no torque is transmitted from operation member 17 to third wheel 10 meshed with center wheel gear 11*c* of center wheel 11, to which no torque is transmitted from operation member 17, and also the torque from operation member 17 is not transmitted to second wheel 9, fifth wheel 8, and rotor 5 which are coupled to third wheel 10. Hence, the rotation of operation member 17 causes neither movement of second hand 3*c* mounted on second wheel 9 nor rotation of rotor 5 of stepping motor 1, that is, the rotation of operation member 17, caused for setting of time, causes movement of minute and hour hands 3*a* and 3*b* alone.

In the above embodiment of time-setting mechanism 4, pinion 18 is made of polyetherimide resin having high flexibility, minute wheel 12 is made of polyacetal resin containing potassium titanate wisker, and setting wheel 19 located between pinion 18 and minute wheel 12 is made of polyetherimide resin containing 30% of potassium titanate wisker. In these three different materials constituting the three gear members, the material of pinion 18 is softest, and that of setting wheel 19 is hardest. Therefore, an impact force, produced when tooth tops of teeth 18*a* of pinion 18 and tooth tops of setting wheel 19 strike one another as shown in FIG. 4, is absorbed by pinion 18, so that deformation of or damage to the teeth of both gear members is prevented. Also, at the time of setting time, teeth 18*a* of pinion 18 will never be seized with teeth of setting wheel 19. Also, if teeth of setting wheel 19 are going to be seized with teeth 18*a* of pinion 18, their seizure is prevented because teeth 18*a* escape. Therefore, in the time-setting operation, pinion 18 can be reliably and smoothly brought into mesh with setting wheel 19. The rotation of operation member 17 thus is reliably and smoothly transmitted from pinion 18 t setting wheel 19, thus permitting smooth time-setting operation. Also, since teeth of setting wheel 19, meshing with teeth 12*c* of minute wheel 12 at all time, will never be deformed or damaged as a result of collision with pinion 18, gear train mechanism 2 can be smoothly operated at all time. Further, even if teeth 18*a*. of pinion 18 are slightly deformed, the normal hand-moving operation of gear train mechanism 2 can be ensured because pinion 18 is not meshed with setting wheel 19 unless the time-setting operation is performed. Further, since teeth 18*a* of pinion 18, teeth of setting wheel 19, teeth 12*c* of minute wheel 12, and teeth b of center wheel 11 have involute gear shapes, these teeth have sufficient mechanical strength and excellent durability even if these gear members are formed of synthetic resin by one-piece moldings.

In the above embodiment, pinion 18 is made of polyetherimide resin, setting wheel 19 is made of polyetherimide resin containing 30% of potassium titanate wisker, and minute wheel 12 is made of polyacetal resin containing potassium titanate wisker. In accordance with the invention, however, it is possible to use other resins for forming pinion 18, setting wheel 19, and minute wheel 12 so long as the material of pinion 18 is a resin having a higher flexibility than the resin materials of minute wheel 12 and setting wheel 19. Further, the mechanical strength of teeth 18*a* of pinion 18 may be increased by forming along the edge of teeth 18*a* a flat or arcular cut surface 18*al* having a small width.

Further, in the above embodiment, setting wheel 19 meshes with minute wheel 12 of gear train mechanism 2, and the rotation of operation member 17 is transmitted via pinion 18 and setting wheel 19 to minute wheel 12. According to the invention, however, it is also possible to make setting wheel 19 mesh with a different gear in gear train mechanism 2, e.g., hour wheel 13 or center wheel 11, so that the rotation of operation member 17 may be transmitted via pinion 18 and setting wheel 19 to the different gear in gear train mechanism 2, e.g., hour wheel 13 or center wheel 11. Further, it is possible to provide an idler gear between setting wheel 19 and a gear in gear train mechanism 2, instead of making setting wheel 19 directly mesh with a gear in the gear train mechanism 2.

Further, it is possible to omit setting wheel 19 and make pinion 18 directly mesh with a gear in gear train mechanism 2, e.g., minute wheel 12 or center wheel 11. In this case, pinion 18 should be formed of a resin material having a higher flexibility than the resin material of the gear in the gear train mechanism 2 with which pinion 18 meshes. Furthermore, pinion 18 may be secured to or formed integrally with operation member 17.

Moreover, while the above embodiment has concerned with a battery-powered type analog wristwatch, and the invention may be applicable to various other analog timepieces.

What is claimed is:

1. A time-setting mechanism for an analog timepiece, the mechanism comprising:

an operation member movable in the axial direction thereof at least between a first position and a second position;

a pinion movable for a first position to a second position in an interlocked relation to the movement of said operation member from said first position to said second position and rotatable, together with said operation member, when said operation member is turned; and an external torque-transmission gear normally rotated in an interlocked relation to the movement of hands;

actuating means for bringing the external torque-transmission gear into mesh with said pinion to transmit a torgue, produced by rotation of said operation member and transmitted from said operation member to said pinion, to the hands when said pinion is moved to said second position with movement of said operation member to said second position;

said pinion and said external torque-transmission gear being made of synthetic resins, and said pinion is made of a resin material having a higher flexibility than the resin material of said external torque-transmission gear.

2. The time-setting mechanism according to claim 1, wherein said external torque-transmission gear is made of a resin material having a higher hardness than the resin material of said pinion.

3. The time-setting mechanism according to claim 1, wherein said external torque-transmission gear is a setting wheel meshing with a gear in a gear train mechanism for transmitting the rotation of a motor to said hands.

4. The time-setting mechanism according to claim 1, wherein said external torque-transmission gear is a gear in a gear train mechanism for transmitting the rotation of a motor to said hands.

5. The time-setting mechanism according to claim 1, wherein said external torque-transmission gear is a minute wheel for transmitting the rotation of a center wheel, on which a minute hand is mounted, to an hour wheel, on which an hour hand is mounted.

6. The time-setting mechanism according to claim 1, wherein said pinion is mounted on said operation member so as to be movable in the axial direction. thereof, and said actuating means moves the pinion in said axial direction between a first position and a second position in an interlocked relation to a movement of said operation member in said axial direction between a first position and a second position.

7. The time-setting mechanism according to claim 1, wherein said pinion is secured to or formed integrally with said operation member.

8. The time-setting mechanism according to claim 1, wherein a pitch on the addendum circle of said pinion and a pitch on the addendum circle of said external torque transmission gear are substantially equal.

9. The time-setting mechanism according to claim 1, wherein a pitch on the addendum circle of said pinion is 0.9 to 1.1 times a pitch on the addendum circle of said external torque-transmission gear.

10. The time-setting mechanism according to claim 1, wherein the teeth of said pinion and teeth of said external torque-transmission gear have involute tooth shapes.

11. A time-setting mechanism for an analog timepiece, the mechanism comprising:

an operation member movable in the axial direction thereof at least between a first position and a second position;

a pinion movable from a first position to a second position in an interlocked relation to the movement of said operation member from said first position to said second position and rotatable, together with said operation member, when said operation member is turned; and a setting wheel normally meshing with one of a plurality of gears in a gear train mechanism;

actuating means for moving the pinion and bring it into mesh with said setting wheel when said pinion is brought to said second position, said setting wheel, when in mesh with said pinion, transmitting to said one of the plurality of gears a torque transmitted from said operation member to said pinion.

said gear train mechanism being coupled between a motor and hands for indicating time, wherein the rotation of said motor is transmitted via the gear train mechanism to said hands for indicating time, said pinion, said setting wheel, and said one of the plurality of gears being made of synthetic resins, and said pinion is made of a resin material having a higher flexibility than the resin materials of said setting wheel and one of the plurality of gears.

12. The time-setting mechanism according to claim 11, wherein said setting wheel is made of a resin material having a higher hardness than the resin materials of said pinion and one of the plurality of gears.

13. The time-setting mechanism according to claim 11, wherein said one of the plurality of gears is a minute wheel for transmitting the rotation of a center wheel, on which a minute hand is mounted, to an hour wheel, on which an hour hand is mounted.

14. The time-setting mechanism according to claim 11, wherein said one of the plurality of gears is an hour wheel, on which an hour hand is mounted.

15. The time-setting mechanism according to claim 11, wherein said one of the plurality of gears is a center wheel, on which a minute hand is mounted.

16. The time-setting mechanism according to claim 11, wherein said pinion is mounted on said operation member so as to be movable in the axial direction thereof, and is moved in said axial direction between a first position and a second position in an interlocked relation to a movement of said operation member in said axial direction between a first position and a second position.

17. The time-setting mechanism according to claim 11, wherein said pinion is secured to or formed integrally with said operation member.

18. The time-setting mechanism according to claim 11, wherein a pitch on the addendum circle of said pinion and a pitch on the addendum circle of said setting wheel are substantially equal.

19. The time-setting mechanism according to claim 11, wherein a pitch on the addendum circle of said pinion is 0.9 to 1.1 times a pitch on the addendum circle of said setting wheel.

20. The time-setting mechanism according to claim 11, wherein the teeth of said pinion, teeth of said setting wheel, and one of the plurality of gears, with which the teeth of said setting wheel are in mesh, have involute tooth shapes.

* * * * *